US005273226A

United States Patent [19]

Dropczynski

[11] Patent Number: 5,273,226

[45] Date of Patent: Dec. 28, 1993

[54] WINDING MACHINE WITH SUPPORT CYLINDERS

[75] Inventor: Hartmut Dropczynski, Dormagen, Fed. Rep. of Germany

[73] Assignee: Jagenberg Aktiengesellschaft, Dusseldorf, Fed. Rep. of Germany

[21] Appl. No.: 842,416

[22] PCT Filed: Aug. 29, 1991

[86] PCT No.: PCT/EP91/01638

§ 371 Date: Mar. 24, 1992

§ 102(e) Date: Mar. 24, 1992

[87] PCT Pub. No.: WO92/05099

PCT Pub. Date: Apr. 2, 1992

[30] Foreign Application Priority Data

Sep. 21, 1990 [DE] Fed. Rep. of Germany ..... 4029914

[51] Int. Cl.[5] ..... B65H 18/20; B65H 19/26

[52] U.S. Cl. ..... 242/56 R; 242/66

[58] Field of Search ..... 242/56 R, 56.6, 66

[56] References Cited

U.S. PATENT DOCUMENTS 3,961,759 6/1976 Fujiwara ..... 242/66
4,485,980 12/1984 Gorner ..... 242/56 R
4,789,109 12/1988 Kyytsonen et al. ..... 242/56 R

FOREIGN PATENT DOCUMENTS 0118384 9/1984 European Pat. Off. .
2920707 12/1980 Fed. Rep. of Germany .
3143281A1 5/1983 Fed. Rep. of Germany .
3527377 2/1987 Fed. Rep. of Germany .
3820846A1 12/1989 Fed. Rep. of Germany .
4003504 8/1991 Fed. Rep. of Germany .
2188911 10/1987 United Kingdom .

OTHER PUBLICATIONS

Japan Patent Abstracts 58-183553 vol. 8, No. 26 (M-273) (1463) Feb. 3, 1984.

*Primary Examiner*—John M. Jillions
*Attorney, Agent, or Firm*—Herbert Dubno; Yuri Kateshov

[57] ABSTRACT

A winding machine includes a pair of support rollers spaced from one another an forming a cradle receiving a core to be wound, and a holding mechanism provided with respective upper and lower guide rollers and at least one elastic endless belt engaging the guide rollers and pressing the web against a periph- ery of one of the support rollers in a working position of the holding mechanism.

6 Claims, 3 Drawing Sheets

WINDING MACHINE WITH SUPPORT CYLINDERS

CROSS REFERENCE TO RELATED APPLICATIONS

This application is a national phase application of PCT/EP91/01638 filed 29 Aug. 1991 and based upon a German application P 40 29 914.7 filed 21 Sep. 1990 under the International Convention.

FIELD OF THE INVENTION

The invention relates to a winding machine with support cylinders for winding material webs, particularly paper or cardboard webs, onto cores.

BACKGROUND OF THE INVENTION

In the above described type of winding machines, in order to keep to a minimum the standstill times required for roll replacements, it is known from DE-OS 29 20 707 to cut the web of material in the cylinder cradle at the point when the full roll is pushed out, by means of a separating device provided with a tear-off blade which can raise through the gap between the cylinders. Thereby, the initial portion of a new web created by this separation is kept wrapped around the support cylinder by negative pressure, until a set of new cores is inserted.

From the yet unpublished German patent application 40 03 504 a generic winding machine with support cylinders is known, wherein rolls are supported by springs and freely rotatable on a support which can be moved upward through the gap between the cylinders in the area of the cylinder cradle, these rolls holding the new initial web portion wrapped around the support cylinder. The separation of the web takes place either by means of a cutting knife fastened to the upper end of the support above the rolls, acting on the web as a tear-off edge at the moment when the fully wound roll is pushed out, or by means of a perforating mechanism arranged in front of the first support cylinder and which weakens the web, so that it tears when the fully wound roll is rotated against a braking force.

In both systems, the position of the separation line in the cylinder cradle has to be selected so that the newly inserted core, at any core diameter, can secure the new initial web portion prior to winding. Independently of the core diameter, the separation line is positioned so high in the cylinder cradle, so that cores with the largest diameter can still safely press down on the web end. Therefore, when cores of a smaller diameter are used, a longer, overhanging web piece has to be wound, leading to the formation of undesirable folds around the core.

A further difficulty consists in gluing the new initial portion of the web to the core. If the cores are provided with a trace of adhesive, it requires high technical efforts to position the cores during insertion so that the trace of glue comes in contact only with the new web beginning at the start of the winding operation, without contaminating the support cylinder (DE-OS 35 27 377). In order to avoid this problem, according to the aforementioned German patent application 40 03 504 the adhesive is applied to the web. Using cores with various diameters requires adjusting of the position of the initial web portion provided with the adhesive strip to the respective core diameter prior to the insertion of new cores.

OBJECTS OF THE INVENTION

It is the object of the invention to provide a generic winding machine with support cylinders so that when the rolls are replaced the newly created initial web portion can be glued as quickly and safely as possible, even in the case of cores with variable diameter.

SUMMARY OF THE INVENTION

According to the invention, the separation line can be set independently of the core diameter at a point in the cylinder cradle below the contact line of cores having the smallest diameter with the wrapped support cylinder. When the winding starts, the initial portion of the web provided with adhesive is fed to the contact line safely and under stress. For this purpose, the belts are flatly applied to the web in the winding range of the support cylinder, in order to hold the initial web portion which has not yen been fastened by the core against the support cylinder. By turning the wrapped support cylinder, the initial web portion is subsequently brought under stress and foldless to the contact line and glued to the core. According to another embodiment of the present invention several spaced apart belts rearranged over the work width in order to apply adhesive in the running direction of the web in the intervals between the belts. A contact between the adhesive strips and the belts is avoided.

Still in another feature of the present invention is the belt tension which can be adjusted to the type of material. The cutting knife is mounted above the upper deflection roller providing thereby separation of light materials when the fully wound-up roll is pushed out.

With dispensers of adhesive tape according to the invention the adhesive strips can be applied to the newly to be created web beginnings, as well as to the web ends, while the separation line is positioned within the cylinder cradle while the production is discontinued The adhesive strip can thereby be applied in one step, which means with an adhesive strip extending over the separation line in running direction, or in two steps, whereby first adhesive strips for fastening the web end to the finished winding rolls are applied and subsequently the adhesive strips for fastening the initial web portion to the core are applied.

According to the invention the perforating mechanism provides the weakening of the web in the case of heavy materials. The weakened location is subsequently moved into the cylinder cradle and there the web is torn off by increasing of the web traction.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
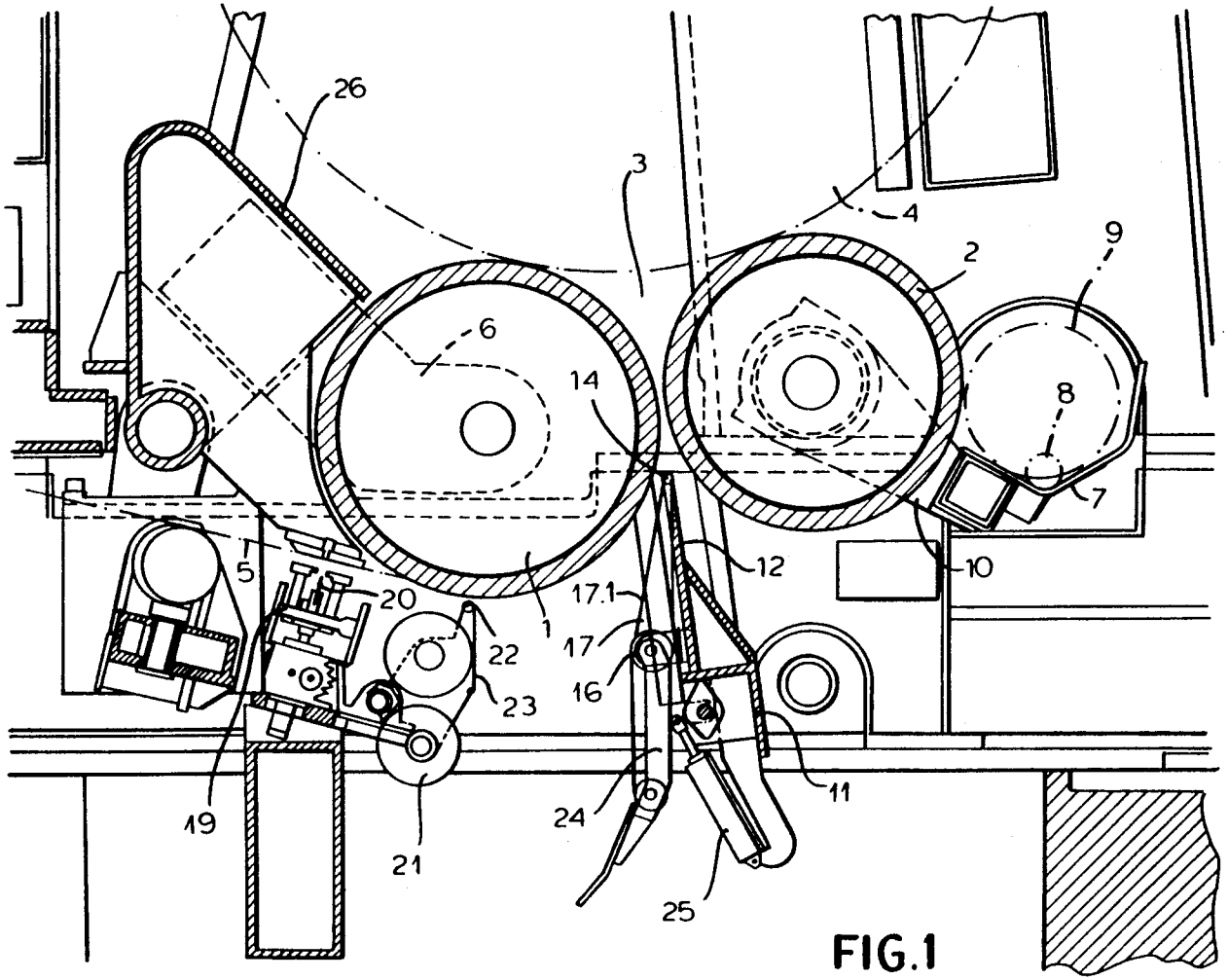
FIG. 1 is a lateral elevated view of a cutout of a winding machine with support cylinders during winding.

The winding machine with support cylinders has two driven support cylinders 1, 2, defining between them a cylinder cradle 3 wherein the winding rolls 4 rest against the support cylinders 1, 2 during winding. The material web 5—which in the example is a paper or cardboard web—separated longitudinally into individual webs, is deflected by support cylinder 1 to be guided from underneath through the gap between the support cylinders 1, 2 into the cylinder cradle 3 and there it is wound onto cores arranged in true alignment In order to push out a fully wound roll 4 over the support cylinder 2, a swingable ejector beam 26 fastened to lateral swivel levers 6 is provided, whose swivel axis is coaxial with the support cylinder 2. A core trough 7 swingable about support cylinder 2 in the direction of the cylinder cradle 3 serves for the insertion of the new cores 8, 9, with variable diameter. The core trough 7 is mounted at the end of lateral swivel levers 10 having a swivel axis which runs coaxially with the support cylinder 2. In the area below the gap between the support cylinders 1, 2, a device which is shown enlarged in FIG. 3, for holding and guiding the new initial web portion created by the separation of web 5 during roll replacement is located.

On a height-adjustable crossbar 11 extending over the entire machine width a flat support 12 extending also over the entire machine width is mounted approximately vertically. At its upper end the support 12 has over the entire work width several spaced apart splice-plate shaped extensions 13, their respective ends supporting guide rollers 14 which can be lifted. The thickness of at least the upper part of the support 12 and of the extensions 13, as well as the diameter of the guide rollers 14 are smaller than the distance between support cylinders 1, 2, so that it is possible to move the guide rollers 14 upwards from a lowered rest position (FIG. 1) through the gap between the support cylinders 1, 2 to a working position above the narrowest point of the gap between the support cylinders (FIG. 2, 3). At the lower end of support 12, at the wrapped support cylinder 1 and across the work width, projections 15 provided pins are arranged at regular distances. On each of these pins a guide roller 16 with the pertaining upper roller 14 is being supported in true alignment, and is freely rotatable and floating rotatable. The guide rollers 16 have a considerably larger diameter than the upper guide rollers 14. In the raised position of the support 12, which is the working position, they reach closely towards support cylinder 1. Between each upper roller 14 and the thereto pertaining lower roller 16 stretches a respective elastic endless belt 17. In order to set the belt tension, the projections 15 with the lower guide rollers 16 are slidably fastened on the support 12. The diameter of the lower guide roller 16 and its distance to the support 12 are selected so that in the raised working position the neighboring belt side 17.1 of each belt 17 rests over an area as large as possible against the web 5 lying on support cylinder 1 and the remote side 17.2 does not rest against the web 5. Thus the belts 17 arranged at intervals over the entire work width are capable to hold an initial web portion on the support cylinder 1 and to guide it upwards during transport. Should the need arise, each belt 17 can be quickly replaced by lifting the upper roller 14 and by laterally stripping it off the lower roller 16.

Figure 2:
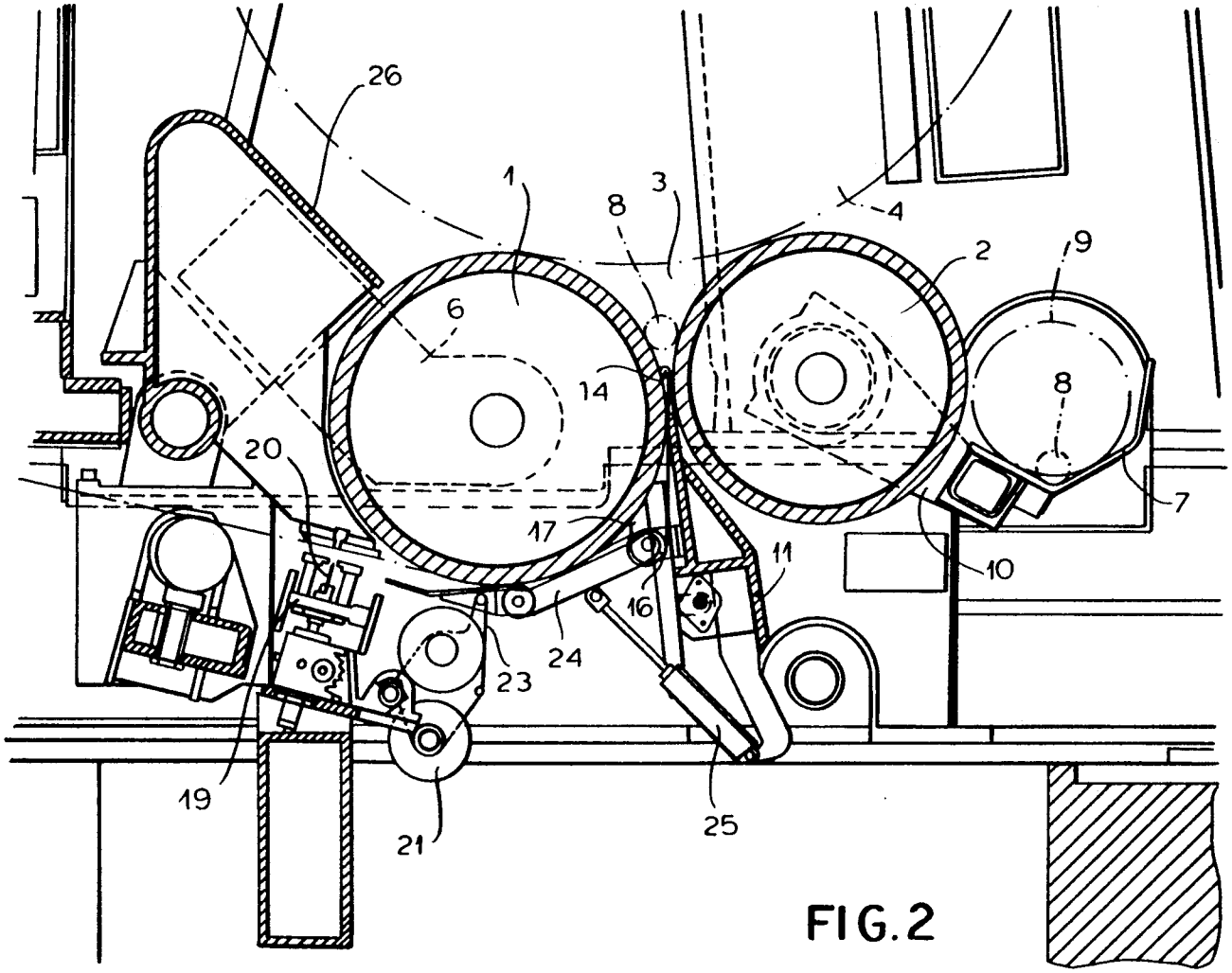
FIG. 2 is a lateral elevational view of the winding machine according to the invention with support cylinders during roll replacement.
Figure 3:
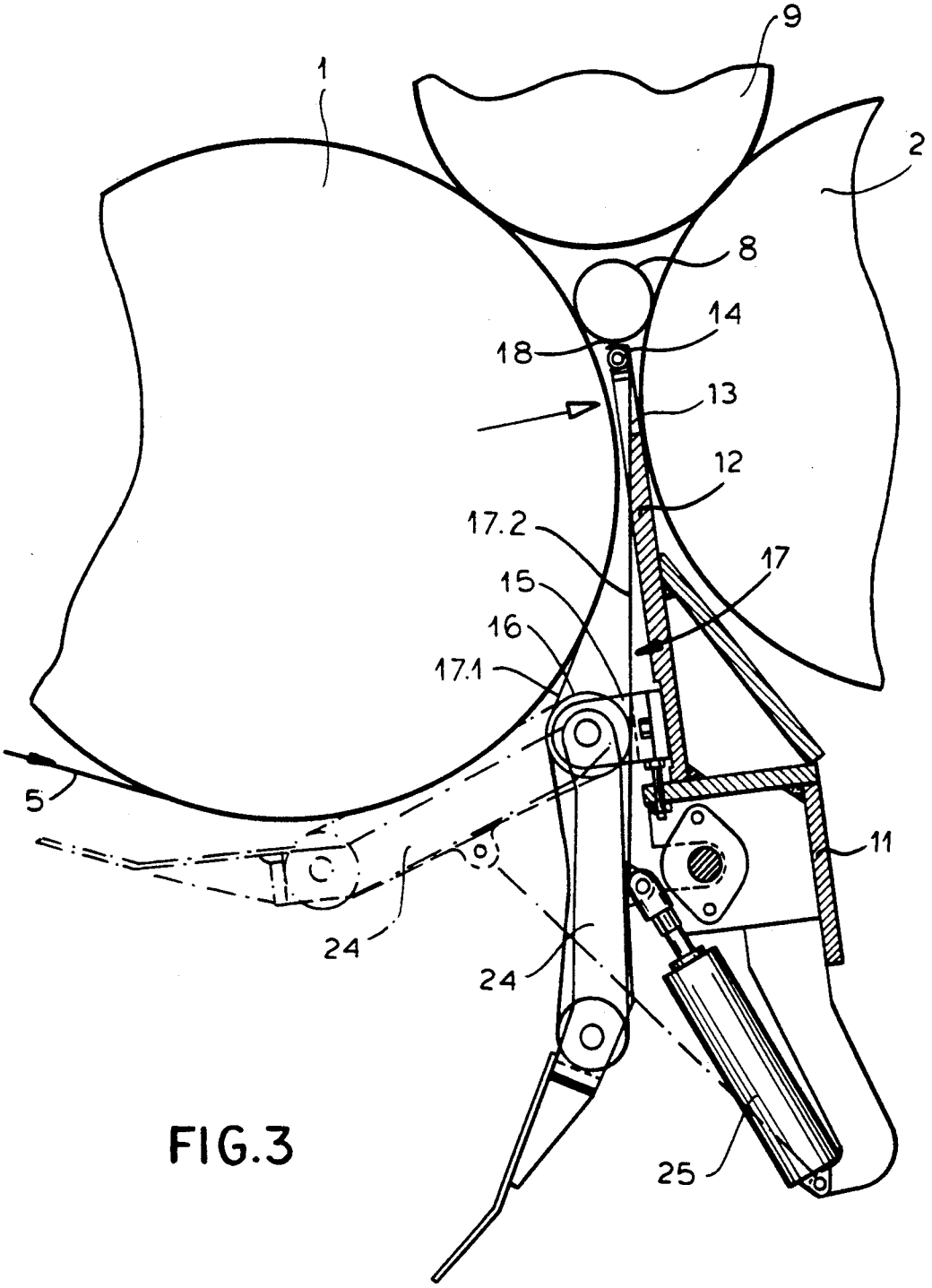
FIG. 3 is an enlarged detailed view of FIG. 2.

In the embodiment shown in FIG. 3, at the upper end of the extension 13 of support 12 a passive sectioning knife 18, e,g, a toothed tear-off blade is fastened, extending over the entire work width and which separates the web 5 when a full winding roll 4 is pushed out over the support cylinder 2. Alternately or additionally, in the embodiment according to FIGS. 1 and 2 a perforating mechanism 19 is arranged in front of the support cylinder 1 on the incoming side. It comprises a toothed perforating blade 20 movable into the path of web 5, in order to weaken heavier paper types, e.g. cardboard along a tear-off line. And then—as will be described in detail later - the web 5 is torn off along the tear-off line by increasing the web traction, as soon as the tear-off line reaches the desired position in the cylinder cradle 3. The web traction is increased by turning the full winding roll 4 by means of a support cylinder 1, 2 against a braking force, which for instance is provided here by the unwinding braking and supply roll not illustrated in the drawing. Underneath the wrapped support cylinder 1—in the presence of perforating mechanism 19 provided behind it in the direction of the web travel—several adhesive tape dispensers 21 are arranged over the work width, each of them applying two-faced adhesive strips 23 onto the web 5 by means of a pressure roller 22 which can be pressed against the support cylinder 1. The adhesive strips 23 are narrower than the interval between two belts 17, and an adhesive-tape dispenser 21 is aligned with each of the intervals, so that the adhesive strips applied to the web 5 are not in contact with the belts 17 when they move the web 5 toward the cylinder cradle 3.

In order to introduce a new web 5 when the supply roll is exchanged, underneath the support cylinder 1 in front of the belts 17 in the travel direction of the web, a belt rocker arm 24 is provided which can be swung towards the support cylinder 1. In order to guide the initial portion of web 5 up to the belts 17, the rear guide rollers of the belt rocker arm 24 are supported on the support 12 coaxially with the lower guide rollers 16 for the belts 17. The swinging motion towards the support cylinder 1 is carried out by means of a piston-cylinder unit 25, which is linked to a downward oriented extension of the crossbar 11.

During the winding operation, the crossbar 11 with the belts 17 and the rocker arm 24 is lowered in a noninterfering rest position (FIG. 1). When the winding rolls 4 are full, the winding machine with support cylinders is stopped, so that the web 5 under web traction is arrested When dealing with heavier paper, e.g. cardboard, which can not easily be separated by the passive sectioning knife 18 at the discharge of the full winding rolls 4, the arrested web 5 is weakened by means of the perforating mechanism 19 as much as required by the type of material, so that later it can be torn due to the increase in web tration. By restarting the winding machine with support cylinders at a lower speed, the tear-off line is then moved into the cylinder cradle 3 below the contact line of cores 8 with the smallest diameter with the support cylinder 1. During this motion, the pressure roller 22 of the adhesive-tape dispenser 21 is pressed against the web 5, so that over the work width on both sides of the tear-off line two-faced adhesive strips are applied to the web 5.

When the tear-off line has reached the desired position, the machine is stopped again and the support 12 with the belts 17 is raised. The sides 17.1 of the belts 17 under stress position themselves in the intervals between the adhesive strips against the web 5, truly securing the new initial web portion to be created against the support cylinder 1. Subsequently by turning the winding roll 4 against an arresting force, e.g. produced by a brake in the unwinding of the supply roll, the web traction is increased to the point where the web 5 tears at the weakened line. With the well secured web beginning—whereby the support cylinder 1 turns fully under the web 5—the web end with the adhesive strips is moved through the contact line between the full winding rolls 4 and the support cylinder 1, so that the web end sticks to the full winding rolls 4. Subsequently the full winding rolls 4 are pushed out over the support cylinder 2 with the ejector beam 26 and new cores 8, at 9 are inserted in the cylinder cradle. Not depending on the diameter of the cores 8, 9, the initial web portion bearing the adhesive strips is still located below the contact line of cores 8, 9 on the support cylinder 1. In order to glue the initial web portion to the cores 8, 9, subsequently the brake is released and the web 5 is moved upwards by turning the support cylinder 1, until the adhesive strips have passed through the contact line of cores 8, 9 on the support cylinder 1. Thereby, the freely running belts 17 provide safe and foldless guidance for the initial web portion up to the contact line . When the new web beginning is glued to the cores 8, respectively 9, the support 12 is lowered and the machine can be accelerated to it full winding speed.

In order to speed up the roll replacement, the support 12 with the belts 17 can be raised already while the machine is stopped for the perforating, in order to apply the belts 17 to the web 5 wrapped about the support cylinder 1. When the tear-off line has reached the desired position, the web is separated by increasing the web traction. This can take place also when the machine runs slowly, without being fully stopped. An additional machine stoppage in order to set the belts 17 is not required.

A further reduction of the time used for roll exchange is achieved when instead of the ejector beam 26 a freely rotating discharge roller is used, which slightly lifts the full winding rolls 4 from the support cylinder 1, prior to sectioning the web 5. The increase in traction preceding the separation takes then place due to an accelerated rotation of the support cylinder 2, without requiring a full rotation of support cylinder 1 under the arrested initial portion of the web. The web end is glued to the full winding roll 4 during the passage of the adhesive strips through the contact line between the winding rolls 4 and the discharge roller.

When the sectioning knife 18 is set in motion during machine deceleration, first adhesive strips are applied to the web on both sides of the future separation line. The adhesive strips fastening the web end to the winding rolls 4 are thereby so far away from the separation line that they already passed through the contact line between the winding rolls 4 and the support cylinder 1 when the web 5 is stopped. The separation of web 4 takes place by pushing out the winding rolls 4 over the support cylinder 2, whereby the sectioning knife 18 acts as a tear-off edge. Also during this process the web 5 is sectioned in the cylinder cradle 3 below the contact line of core 8 with the smallest diameter at the support cylinder 1. The fastening of the new initial web portion to the cores 8, or 9 takes place after the full winding rolls 4 have been pushed out in aforedescribed manner.

I claim:

1. A winding machine for winding webs of material, particularly paper or cardboard webs onto cores, comprising:

means for delivering a web;

an upstream support cylinder engaged by the web;

a downstream support cylinder juxtaposed with said upstream cylinder across said web and spaced from said upstream support cylinder to form a gap therebetween and define a cradle receiving a core to be wound, said web being deflected along said upstream cylinder and guided from underneath through said gap.

a device for separating said web during winding roll replacement; and holding means for pressing the web against said upstream cylinder in said gap, said holding means including:

a support movable between raised and lowered positions, said support extending over a work width of said support cylinders and being provided with upper and lower ends and being raised toward said gap in said raised position with said upper end in said gap, freely rotatable upper and lower guide rollers mounted respectively on said upper and lower ends of said support, said upper rollers being formed with respective diameters smaller than a distance between said cylinders, and at least one elastic endless belt engaging said upper and lower guide rollers, said lower guide rollers being circumferentially offset in the direction towards the upstream support cylinder, so that one side of the belt is pressed with surface contact against said web on said upstream support cylinder in said raised position.

2. The winding machine defined in claim 1 wherein said holding means includes a plurality of endless belts spaced from one another, each of said belts engaging a respective pair of said upper and lower guide rollers.

3. The winding machine defined in claim 1 wherein said lower guide rollers are mounted slidably on said support for adjusting a tension of said belt.

4. The winding machine defined in claim 1 wherein said defice includes a secontioning knife extending across said work width and mounted on said upper end of the support downstream of said upper guide rollers.

5. The winding machine defined in claim 1 further comprising gluing means along said path upstream of said holding means for applying a two-sided adhesive tape to the web, said gluing means including at least one adhesive-tape dispenser mounted beneath said downstream roll.

6. The winding machine defined in claim 1 wherein said device includes a perforating mechanism movable transversely to said path and juxtaposed with said upstream support cylinder.

* * * * *